US008087120B1

(12) United States Patent
Lochridge

(10) Patent No.: US 8,087,120 B1
(45) Date of Patent: Jan. 3, 2012

(54) BABY BOTTLE CLEANING BRUSH WITH REVERSIBLE SPLASH GUARD

(76) Inventor: Beau Alec Lochridge, Dallas, TX (US)

( * ) Notice: Subject to any disclaimer, the term of this patent is extended or adjusted under 35 U.S.C. 154(b) by 0 days.

(21) Appl. No.: 12/824,143

(22) Filed: Jun. 25, 2010

(51) Int. Cl.
*A47L 17/00* (2006.01)

(52) U.S. Cl. ..... 15/164; 15/248.1

(58) Field of Classification Search ..... 15/65, 71, 15/164, 165, 211–213, 248.1
See application file for complete search history.

(56) References Cited

U.S. PATENT DOCUMENTS

| | | | | | |
|---|---|---|---|---|---|
| 562,134 | A | * | 6/1896 | Haner | 401/99 |
| 1,199,837 | A | * | 10/1916 | Thompson | 15/248.1 |
| 1,355,385 | A | * | 10/1920 | Buchanan et al. | 401/277 |
| 2,792,579 | A | * | 5/1957 | Roy | 15/25 |
| 5,709,003 | A | * | 1/1998 | Batch | 15/106 |

FOREIGN PATENT DOCUMENTS

FR 2756168 * 5/1998

* cited by examiner

*Primary Examiner* — Mark Spisich
(74) *Attorney, Agent, or Firm* — Warren V. Norred

(57) ABSTRACT

A baby bottle cleaning brush which includes a reversible cover between the brush and handle that covers the opening of a baby bottle, so when the action of the brush on the lip of the baby bottle opening would tend to spray water, the brush cover envelops the bottle opening and prevents the spray from spreading out and hitting the user or surroundings.

1 Claim, 1 Drawing Sheet

BABY BOTTLE CLEANING BRUSH WITH REVERSIBLE SPLASH GUARD

CROSS-REFERENCE TO RELATED APPLICATIONS

None.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A "SEQUENCE LISTING," A TABLE, OR A COMPUTER PROGRAM LISTING APPENDIX SUBMITTED ON COMPACT DISC AND AN INCORPORATION-BY-REFERENCE OF THE MATERIAL ON THE COMPACT DISC

None.

BACKGROUND OF THE INVENTION

1) Field of the Invention

The present invention pertains to a cleaning brush equipped with a splash guard to keep water from spraying in an unwanted fashion when hand-washing baby bottles and other similar containers.

2) Description of the Related Art

Baby bottles are well known in the art. They typically have a screw-on lid or nipple that is removable for cleaning. Because baby bottles are often hand-washed, brushes used for cleaning them are also well known in the art.

When these bottles are cleaned, a brush is typically inserted through the mouth of the bottle, with the brush used to scrub the bottle's interior. As the brush's bristles work to clean around the mouth of the bottle, the bristles often spray water on the surrounding area or person working with the bottle.

What is needed is an apparatus that can brush a bottle and create no water spray during the scrubbing process.

BRIEF SUMMARY OF THE INVENTION

The present invention is a baby bottle cleaning brush with a splash guard mounted between the handle and the brush's thistles (or other brushing element). The splash guard prevents water from spraying onto surrounding areas or the user from the cleaning motion of the brush as it cleans the baby bottle.

The main object of the invention is to prevent water from spraying on a person or his surroundings that is cleaning a container with a brush by including a splash guard with the brush. A secondary object is to allow the brush's splashguard to be easily cleaned.

The detailed specifications of the invention are given in the following description in connection with the attached drawings. It should be mentioned that the purpose of these drawings is merely to illustrate the text of the description, and they do not in any way constitute a limitation of the scope of the invention. Though the invention is conceived while considering water spray from washing baby bottles, it is useful for cleaning any similar container.

DETAILED DESCRIPTION OF THE INVENTION

Figure 1:
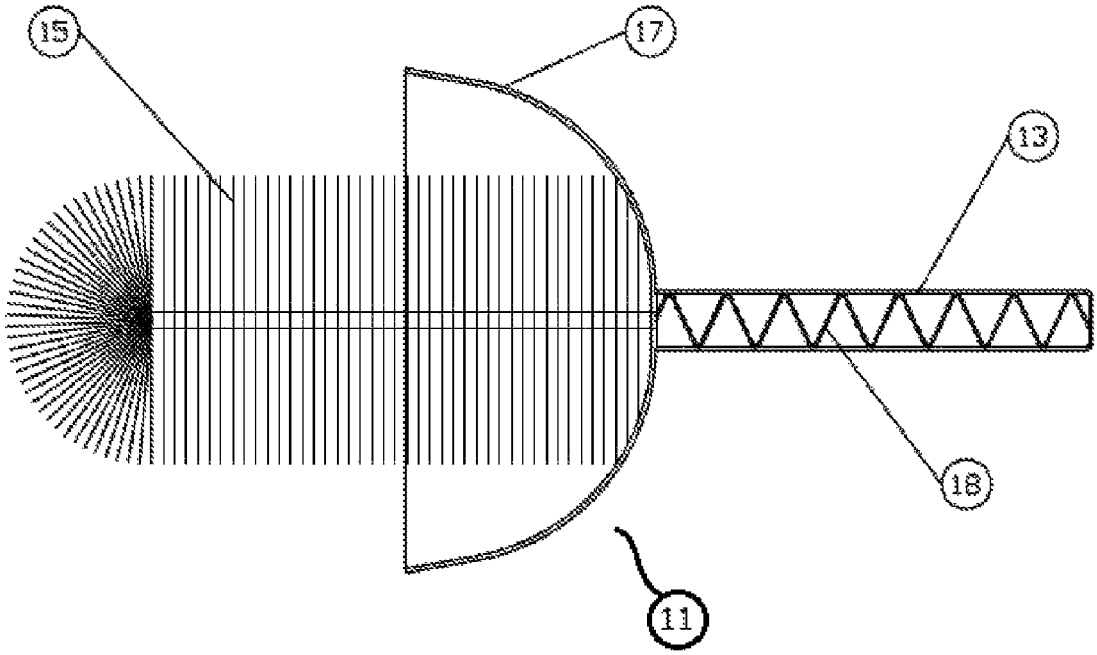
FIG. 1—Half-section view of the splashguard-equipped brush.

The brush 11 comprises a handle 13 and a brush 15 that extends from the handle, and a splash guard 17 mounted between the handle and brush, as shown in FIG. 1.

The splash guard 17 can be permanently mounted in place when the brush is manufactured, or be made of an elastomer or other material that allows it to conform to the shape of the handle and slide onto the brush from the handle.

The splash guard d 17 is constructed so it cups over the top of a container being washed when the brush 15 is inserted into the container. By covering the opening of the container as it is being brushed, any water spray resulting from the cleaning action is kept within the envelope of the splash guard 17.

Though not a requirement, the splash guard 17 may be made from an elastomeric material that allows it to be reversed and made concave in the direction of the handle 13, allowing for easy cleaning of the interior side of the splash guard 17.

Though the invention was conceived as an aid for those washing baby bottles, the splash-guard equipped bottle brush can be suitable for any similar container.

Because the invention does not require a particular shape for the splash guard 17, the splash guard can be designed in a decorative pattern. For example, FIG. 1 shows the handle 13 to be constructed with a wide flat end capable of holding the brush 15 vertically, and the splash guard 17 created to resemble a flower.

The splash guard 17 is spring-loaded 18 so it can retract to allow the brush 15 to extend down farther into a bottle as needed.

The matter set forth in the above description and accompanying drawings is offered by way of illustration only and not as a limitation. While particular embodiments have been shown and described, it will be apparent to those skilled in the art that changes and modifications may be made without departing from the broader aspects of applicants' contribution.

The invention claimed is:

1. A baby bottle brush apparatus, comprising a. a handle, b. a brush mounted on an extension from the handle, c. a removable and reversible splash guard mounted between the handle and brush, said splash guard constructed with a concave shield that covers the bottle opening when the brush is used to clean the bottle's inside, and where the splash guard is spring-loaded so it retracts from the brush and toward the handle as pressure is placed on the splash guard when a user inserts the apparatus into a container.

* * * * *